US005896595A

United States Patent [19]

Spencer

[11] Patent Number: 5,896,595

[45] Date of Patent: Apr. 27, 1999

[54] SHAMPOO BOWL WITH DUAL SUPPORT MEMBERS

[76] Inventor: Gary W. Spencer, 2465 S. Ponte Vedra Blvd., Ponte Vedra Beach, Fla. 32082

[21] Appl. No.: 08/967,842

[22] Filed: Nov. 12, 1997

[51] Int. Cl.[6] ..... A45D 19/08

[52] U.S. Cl. ..... 4/519; 4/523; 4/645

[58] Field of Search ..... 4/515–516, 518, 4/519, 523, 645

[56] References Cited

U.S. PATENT DOCUMENTS

| | | | |
|---|---|---|---|
| 906,410 | 12/1908 | Greene | 4/523 X |
| 2,315,153 | 3/1943 | Ellinger | 4/523 |
| 3,108,288 | 10/1963 | Herzog | 4/519 |
| 3,488,781 | 1/1970 | Kehoe | 4/519 |
| 4,998,303 | 3/1991 | Smithers | 4/523 |

FOREIGN PATENT DOCUMENTS

| | | | |
|---|---|---|---|
| 1133593 | 11/1956 | France | 4/519 |
| 5004484 | 2/1995 | WIPO | 4/519 |

*Primary Examiner*—Charles E. Phillips
*Attorney, Agent, or Firm*—Thomas C. Saitta

[57] ABSTRACT

A shampoo rinse bowl having a first neck support member and a separate second upper torso support member, where the first support member supports the neck of a person several inches below the hairline and the second support member supports the upper torso below the junction of the neck with the torso. An open area is provided between the two support members. The bowl may be raised vertically and tilted, either independently or simultaneously by hydraulic or pneumatic pistons or the like. Preferably the bowl is tilted by raising the rear of the bowl while the height of the forward portion of the bowl remains the same. Also preferably, the bowl will be tilted about five degrees for each inch change in height.

20 Claims, 3 Drawing Sheets

SHAMPOO BOWL WITH DUAL SUPPORT MEMBERS

BACKGROUND OF THE INVENTION

This invention relates generally to the field of shampoo or rinsing bowls used to capture and remove fluids in a hair shampooing or treatment situation, such as the bowls commonly found in hair and beauty salons. More particularly, the invention relates to such bowls where the person being attended is in a generally reclined position with the head suspended over the bowl, where the bowl is provided with two distinct support members which support the person at the neck and at a point beneath the junction of the neck and torso. The invention also relates to such bowls which are mounted onto a support pedestal in such a manner that the bowl can be raised and tilted.

It is common practice in hair and beauty salons to shampoo a person's hair prior to cutting. It is also common to provide various treatments which require application of substances followed by a rinsing of the substances from the hair. Shampoo bowls having a water source, a large bowl or basin, and a drain are typically provided with a recess in the forward perimeter of the bowl which receives and cradles a person's neck so that the head is suspended over the bowl with sufficient room for the technician to undertake the necessary treatment steps on the person's hair. The recess is generally somewhat U-shaped so as to encircle a portion of the neck to block water or other fluids from splashing or flowing out of the basin and onto the person. This design tends to be relatively uncomfortable, since the neck is supported at only one point and the neck recess serves as a fulcrum between the unsupported shoulders and the head, requiring the technician to help support the head during the treatment to minimize discomfort to the person being treated. When the head is not supported, the weight of the head causes uncomfortable pressure at the single point of support, which usually results in the person tensing the neck muscles to raise the head slightly to alleviate the pressure. Additionally, the U-shaped recess is typically too narrow for larger people.

Most shampoo bowls are also fixed at a single height most appropriate for an "average" technician, meaning that variations in the height of the person being treated and similar variations relative to the technician are not taken into account. In addition, since the bowl cannot be moved, the technician must raise and lower the person's head with one hand to perform various operations, such as thoroughly rinsing shampoo from the entire head, meaning that the technician has only one free hand to perform the operation.

It is an object to provide an improved shampoo or rinsing bowl which provides better and more comfortable support to the person being treated, as well as providing the technician with better accessibility. It is a further object to provide such an improved shampoo bowl by creating a bowl having two separate support members, a first neck support bridging member which supports the neck in the area of the 6th vertebra and a second support recess member which supports the torso at the point slightly below where the neck joins the torso and shoulders in the area of the 8th vertebra, such that the head of the person is suspended over the bowl while supported in two places rather than one. It is a further object to provide such a bowl where the bowl height and tilt angle are adjustable, where the bowl is mounted on a pedestal having hydraulic, mechanical, pneumatic or other means to raise and tilt the bowl, where the raising and tilting are preferably independently controlled.

SUMMARY OF THE INVENTION

The invention is in general a shampoo or rinsing bowl which supports the upper torso and neck of a person in a reclined position having his or her hair shampooed, dyed or treated with any other fluid or substance. The invention supports the person at two separate points such that the person's head is suspended freely over the bowl so excess shampoo, rinsing fluid, etc. is captured within and drained from the bowl, where the person does not have to independently hold the head in place by muscle contraction. The shampoo bowl is provided with dual support members, the first support member being positioned to support the neck several inches below the hairline in the vicinity of the sixth vertebra and the second support member being positioned to support the upper torso in the area below the juncture of the neck and torso, in the vicinity of the eighth vertebra, also known as the first dorsal vertebra. The second support member comprises a relatively broad and flat recess formed in the forward perimeter of the bowl sized such that it can receive and cradle a person at the juncture below where the neck joins the torso. The first support member comprises a generally curved bridge member which extends into and over the interior of the bowl, slightly elevated in height above the second support member and joined to the bowl such that an open area is defined between the first support member and the second support member, whereby any fluids which pass beyond the first support member will fall into the bowl between the two members.

In the preferred embodiment, the shampoo bowl is mounted onto a support pedestal such that the bowl may be raised or tilted by mechanical, hydraulic, pneumatic or other suitable means to properly position the bowl at the optimum height and angle for comfort and accessibility. As the bowl is raised, the bowl automatically tilts such that the forward perimeter is lowered relative to the back of the bowl. This combination of movements allows the technician to perform rinsing operations or the like while the bowl is in motion, thus negating the need to lift the person's head with one hand to alter the relative angle of the head. In the most preferred embodiment, the height and tilt angle of the bowl are independently controlled such that the bowl will rise and tilt simultaneously or can be independently adjusted as to height or angle.

DETAILED DESCRIPTION OF THE INVENTION

Figure 2:
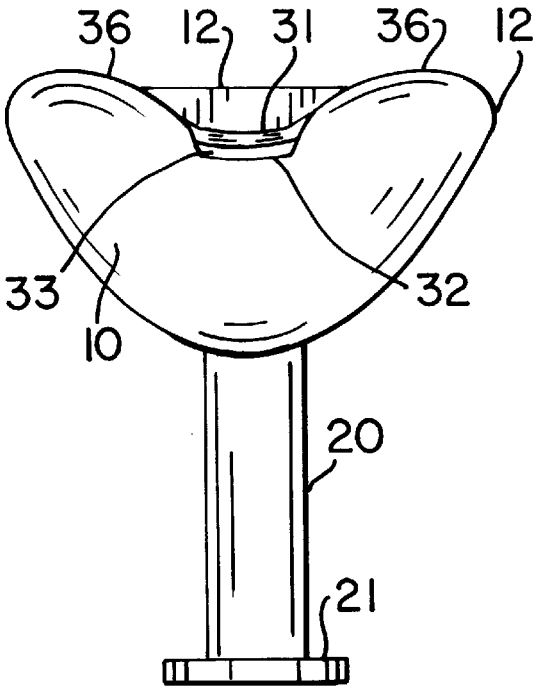
FIG. 2 is a front view of the bowl and pedestal.
Figure 1:
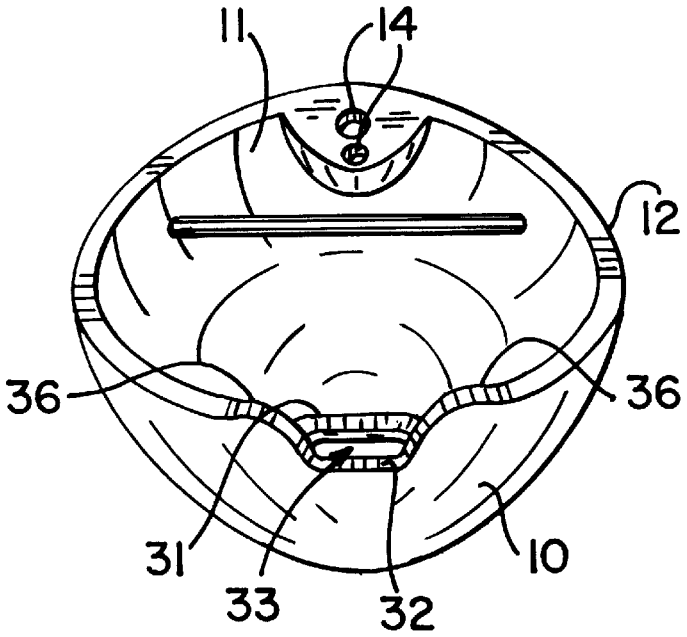
FIG. 1 is a perspective view showing the bowl of the invention.
Figure 3:
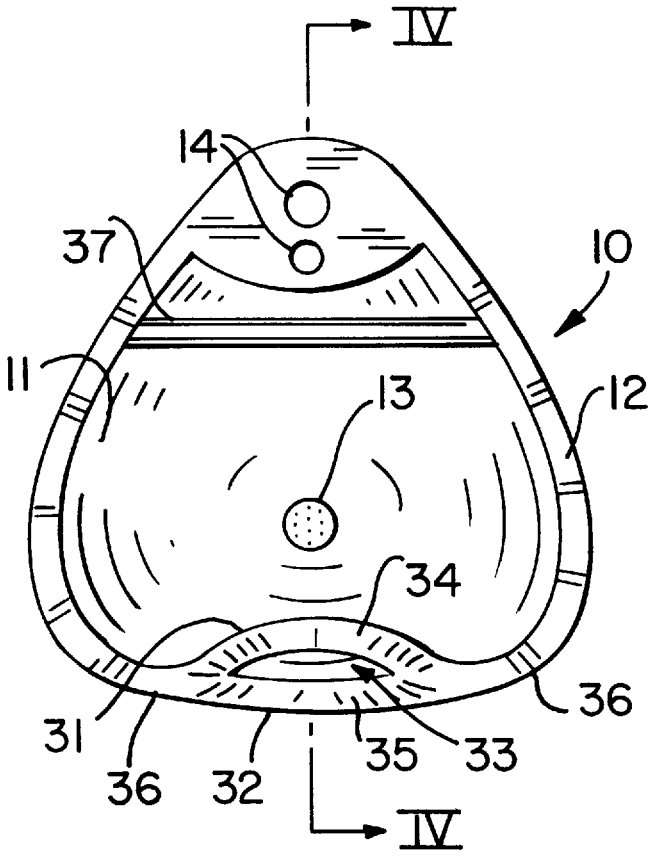
FIG. 3 is a top view of the bowl.

With reference to the drawings, the invention will now be described in detail with regard for the best mode and the preferred embodiments.

Referring in general to FIGS. 1 through 4, the invention is seen to comprise a shampoo or rinsing bowl 10, typical formed of a ceramic or metal material, having a basin 11 surrounded by an upper perimeter rim 12 where the basin 11 captures fluids and funnels the fluids to a drain 13 connected to the general plumbing system of the building. In a typical configuration, plumbing apertures 14 are provided at the rear of the bowl 10 for attachment of various plumbing accessories, such as water control handles, shampoo spray nozzles, etc., although such accessories could be mounted independently of the bowl 10. The bowl 10 may be mounted directly to a wall or, preferably, affixed on a pedestal column 20 with a base member 21 standing on the floor. It is preferred that the basin 11 be several inches deeper than standard bowls now in use, such that the interior depth is approximately twelve inches.

The bowl 10 comprises a first support member 31 for supporting the neck of a person being treated at a point about two inches below the hairline in the vicinity of the 6th vertebra and a second support member 32 for supporting the upper torso at a point below the juncture of the neck and torso, in the vicinity of the 8th vertebra. The second support member 32 is positioned along the forward part of perimeter rim 12 of the bowl 10 and comprises a ledge which is slightly lower than the remainder of the bowl perimeter 12. The second support member 32 has a generally flat and relatively broad upper surface 35 to comfortably support the upper torso of the person, and is wider than the standard neck supports found in typical bowls now in use. Resilient pads or cushions, as known in the art, may be placed on the upper surface 35 to increase comfort. The portion of the perimeter 12 to either side of the second support member 32 is preferably raised a distance above the remainder of the perimeter 12 to create a pair of splash guard members 36 which extend vertically to create a protective shield during the treatment to protect the shoulders and clothing, and most preferably also extend outwardly as well.

The first support member 31 is a bridging member which extends from the perimeter rim 12 and splash guards 36 into the interior of the bowl 10 and out over the basin 11. The first support member 31 preferably is formed by curving the perimeter 12 inward at points adjacent the sides of the second support member 32, but could alternatively be a member separate from the perimeter 12 which is affixed to the interior wall of the basin 11 by suitable fastening means and, if necessary, supported by generally vertical members. The upper surface 34 of the first support member 31 is likewise generally flat in the front to rear direction to provide comfortable support to the person, and is preferably slightly concave in the lateral direction in order to better cradle the neck and block fluid flow. The combination of the first support member 31 and the second support member 32 define an open area 33 between the two members 31 and 32, such that any fluid accidentally flowing or splashing into this region passes into the basin 11. Preferably, the first support member 31 and the second support member 32 are separated about three to four inches at the point of maximum separation. The upper surface 34 of the first support member 31 is also preferably about one inch higher than the upper surface of the second support member 32 when the bowl 10 is in its most horizontal or fixed position. Upper surface 34 may also be supplied with suitable pads or cushions to increase comfort.

Figure 4:
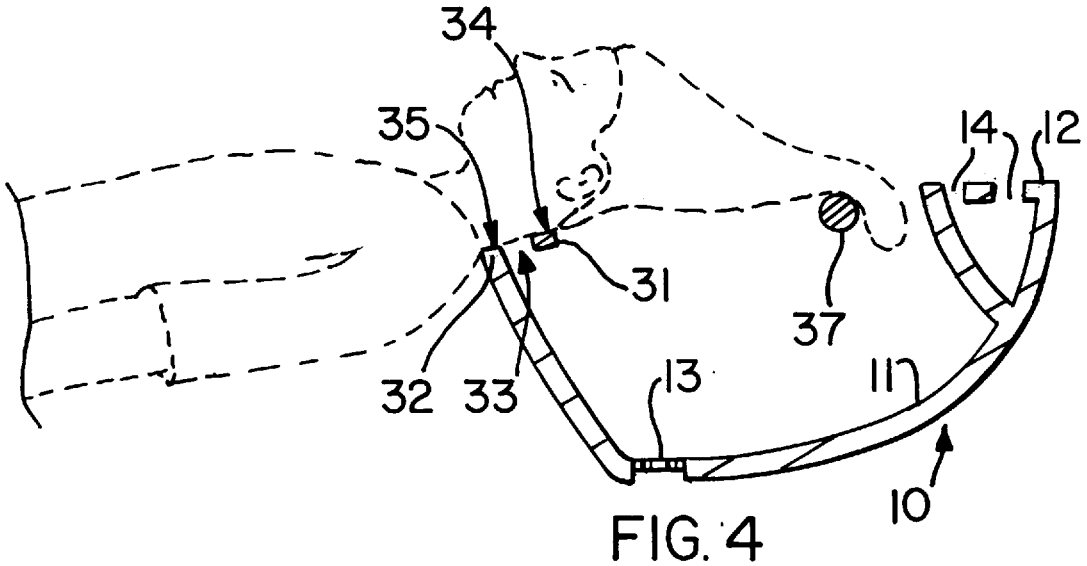
FIG. 4 is a cross-sectional view of the bowl taken along line IV—IV of FIG. 3.

With this configuration, the bowl 10 supports the horizontally reclining person being treated at two points rather than at one point as with conventional bowls. As seen in FIG. 4, the first support member 31 supports the person's neck several inches below the hairline at about the location of the sixth vertebra, while the second support member 32 supports the person's upper torso below the junction of the neck with the torso at about the location of the eighth vertebra, with the broadness of the second support member 32 being such that there is ample distance to account for the spread of the person's shoulders or torso at the point of juncture with the neck. The upper portions of the shoulders may abut directly against the generally flat front of the bowl 10 below the splash guards 36. In addition to the above, a hair bar 37, preferably removable, may be positioned within the basin 11 toward the back side. Long hair may be draped over the hair bar 37 to prevent it from contacting the bottom of the basin 11 or drain 13.

Figure 5:
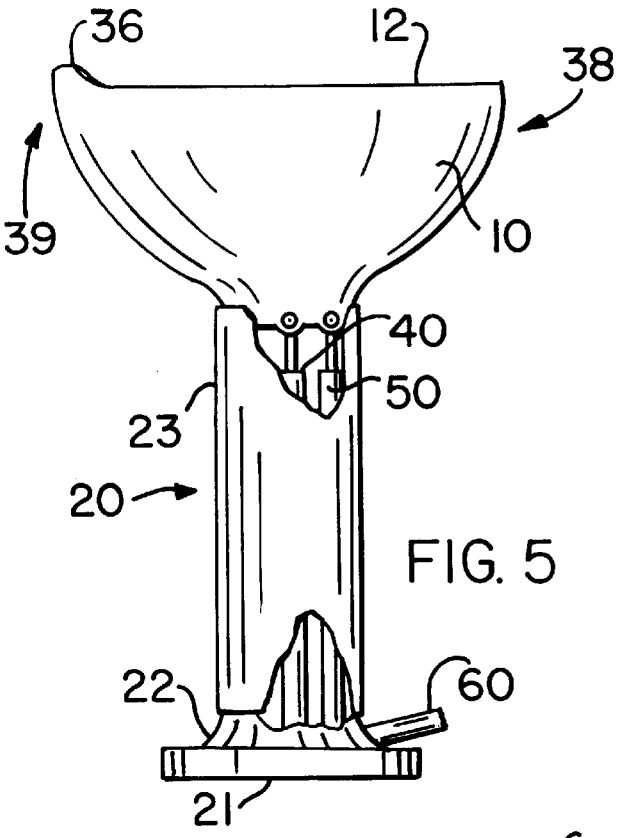
FIG. 5 is a side view of the bowl and pedestal, partially exposed to show the raising and tilting means, with the bowl in the lowest and most horizontal position.
Figure 6:
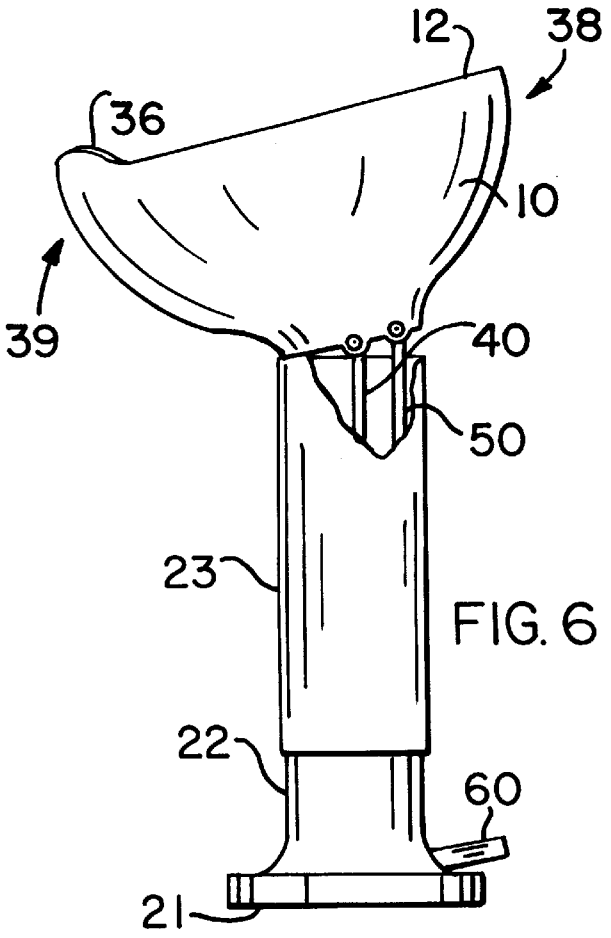
FIG. 6 is a side view of the bowl and pedestal, with the bowl in a partially elevated and tilted position.

In the most preferred embodiments, the bowl 10 is pivotally connected to a pedestal 20 in a manner which allows the bowl 10 to be raised and tilted in the forward direction. As seen in FIGS. 5 and 6, this requires raising means 40 to raise and lower the bowl 10 vertically and tilting means 50 to raise and lower the rear 38 of the bowl 10 in order to tilt the bowl 10 such that the rear 38 of the bowl 10 is higher than the front 39. Conversely, means 40 can also be used to tilt the bowl 10 such that the front 39 is higher than the rear 38 by raising means 40 with means 50 stationary or by lowering means 50 with means 40 stationary. Vertical movement means 40 and tilting means 50 may comprise any suitable mechanical assemblies, including gear and screw constructions, hydraulically operated pistons, pneumatically operated pistons, or other such apparatus which can be controlled to operatively change the position of the bowl 10, and such means being well known are shown only generally in the drawings. As shown in the figures, the vertical movement means 40 and tilting means 50 may comprise pistons which are controlled by foot operated actuators 60. The vertical movement means 40 is attached to said bowl 10 such that extension or contraction of the vertical movement means elevates or lowers the entire bowl 10 relative to the floor or to the pedestal 20 itself if it is a stationary member. The pedestal 20 is preferably constructed with an inner sleeve 22 and an outer sleeve 23 which may be relatively extended and contracted by the vertical movement means 40 to vary the height of the bowl 10 from the floor. It is preferred that the tilting means 50 be able to vary the bowl attitude from horizontal to about 45 degrees and that the vertical movement means 40 be able to raise and lower the bowl 10 about eight inches.

The vertical movement means 40 and the tilting means 50 may operate independently or in conjunction, or both. It is most preferred that the invention be so constructed such that the technician can raise and tilt the bowl 10 simultaneously and automatically, with the vertical movement means 40 and the tilting means 50 operating in conjunction in a manner to provide approximately a five degree forward tilt for each inch that the bowl 10 is raised, and a corresponding five degree flattening for each inch the bowl 10 is lowered. Independent operation of the vertical movement means 40 and tilting means 50 allows the technician to properly adjust the stationary position of the bowl 10 to accommodate variations in the size and height of the person being treated, as well as variations in the size of the technician, and to also be able to position the bowl 10 in the optimum manner for the particular treatment procedure being undertaken. Simultaneous operation of the vertical movement means 40 and tilting means 50, where the degree of tilt is an automatic function of the combined means 40 and 50, allows the technician to tilt upward the head of the person being treated without having to raise the person's head by hand. This is especially useful in rinsing operations.

It is contemplated that certain equivalents and substitutions may be obvious to those skilled in the art, and as such the true scope and definition of the invention is to be as set forth in the following claims.

I claim:

1. In a shampoo bowl for rinsing and treating a person's hair, said bowl having a front, a rear, a perimeter rim, a basin and a drain, the improvement comprising a first support member having an upper surface and a second support member having an upper surface, where said first support member is an extension of said perimeter rim and supports the neck of a person and said second support member supports the upper torso of a person in a generally horizontally inclined position, where said first support member extends into and over said basin and is separate from said second support member such that an open area above the basin is defined between said first support member and said second support member.

2. The bowl of claim 1, further comprising a pedestal to support said bowl, where said bowl is pivotally mounted to said pedestal such that said bowl can be tilted and raised, and further comprising vertical movement means to raise said bowl and tilting means to tilt said bowl.

3. The bowl of claim 1, where said upper surface of said first support member is higher than said upper surface of said second support member.

4. The bowl of claim 1, where said upper surface of said first support member is approximately one inch higher than said upper surface of said second support member.

5. The bowl of claim 1, where said open area between said first support member and said second support member is approximately three inches in distance.

6. The bowl of claim 1, further comprising splash guard members positioned to either said of said second support member, said splash guard members each comprising a raised portion of the perimeter rim.

7. The bowl of claim 1, where said first support member supports the neck of a person about two inches below the hairline and said second support member supports the upper torso of a person slightly below the junction of the neck and torso.

8. The bowl of claim 1, where said first support member supports the neck of a person in the vicinity of the 6th vertebra and said second support member supports the upper torso of a person in the vicinity of the 8th vertebra.

9. The bowl of claim 1, further comprising a hair bar mounted across said basin for supporting long hair above said basin.

10. The bowl of claim 2, where said vertical movement means and said tilting means are means chosen from a group consisting of hydraulically operated pistons, pneumatically operated pistons and mechanical assemblies.

11. The bowl of claim 10, where said pedestal comprises an inner sleeve and outer sleeve surrounding said inner sleeve, where said inner sleeve and outer sleeve are capable of relative movement to extend or contract said pedestal.

12. The bowl of claim 10, where said tilting means raises said rear of said bowl without altering the height of said front of said bowl.

13. The bowl of claim 10, where said vertical movement means and said tilting means operate independently of each other.

14. The bowl of claim 10, where said vertical movement means and said tilting means operate in conjunction.

15. The bowl of claim 14, where said tilting means tilts said bowl approximately five degrees for each approximate one inch in height said bowl is vertically moved by said vertical movement means.

16. In a shampoo bowl for rinsing and treating a person's hair, said bowl having a front, a rear, a perimeter rim, a basin and a drain, the improvement comprising a first support member having an upper surface and a second support member having an upper surface, where said first support member supports the neck of a person and said second support member supports the upper torso of a person in a generally horizontally inclined position, where said first support member extends into and over said basin and is separate from said second support member such that an open area above the basin is defined between said first support member and said second support member, and further comprising a pedestal to support said bowl, where said bowl is pivotally mounted to said pedestal such that said bowl can be tilted and raised, and further comprising vertical movement means to raise said bowl and tilting means to tilt said bowl, where said vertical movement means and said tilting means operate in conjunction and are means chosen from a group consisting of hydraulically operated pistons, pneumatically operated pistons and mechanical assemblies, and where said tilting means tilts said bowl approximately five degrees for each approximate one inch in height said bowl is vertically moved by said vertical movement means.

17. In a shampoo bowl for rinsing and treating a person's hair, said bowl having a front, a rear, a perimeter rim, a basin and a drain, the improvement comprising a first support member having an upper surface and a second support member having an upper surface, where said first support member supports the neck of a person and said second support member supports the upper torso of a person in a generally horizontally inclined position, where said first support member extends into and over said basin and is separate from said second support member such that an open area above the basin is defined between said first support member and said second support member, and a hair bar mounted across said basin for supporting long hair above said basin.

18. The bowl of claim 17, where said upper surface of said first support member is higher than said upper surface of said second support member.

19. The bowl of claim 17, further comprising splash guard members positioned to either said of said second support member, said splash guard members each comprising a raised portion of the perimeter rim.

20. The bowl of claim 17, where said first support member supports the neck of a person in the vicinity of the 6th vertebra and said second support member supports the upper torso of a person in the vicinity of the 8th vertebra.

* * * * *